United States Patent [19]

Toda et al.

[11] Patent Number: 4,753,824

[45] Date of Patent: Jun. 28, 1988

[54] FLUID DISPENSING SYSTEM AND METHOD FOR DISCHARGING THERMOPLASTIC RESIN ONTO A SURFACE

[75] Inventors: Masaaki Toda, Kawasaki; Yoshio Ichikawa, Yokohama, both of Japan

[73] Assignee: Nordson Corporation, Westlake, Ohio

[21] Appl. No.: 818,816

[22] Filed: Mar. 6, 1986

Related U.S. Application Data

[62] Division of Ser. No. 450,260, Dec. 16, 1982, Pat. No. 4,592,495.

[30] Foreign Application Priority Data

Dec. 29, 1981 [JP] Japan ..... 56-215170

[51] Int. Cl.[4] ..... B05D 5/10; B05C 5/04

[52] U.S. Cl. ..... 427/286; 118/323; 118/697; 427/208.2; 901/43

[58] Field of Search ..... 901/43; 222/526, 527, 222/529, 533, 536; 118/323, 697; 427/286, 208.2

[56] References Cited

U.S. PATENT DOCUMENTS

| | | | |
|---|---|---|---|
| 1,128,798 | 2/1915 | McLaughlin | 285/168 |
| 2,240,458 | 4/1941 | Grise | 222/236 X |
| 2,270,928 | 1/1942 | Browne | 285/276 |
| 2,379,035 | 6/1945 | Phillips | 285/168 X |
| 2,384,360 | 9/1945 | Allen et al. | 285/276 X |
| 2,394,715 | 2/1946 | Phillips | 285/276 X |
| 2,414,997 | 1/1947 | Atkins | 285/97.3 |
| 2,518,216 | 8/1950 | Barker | 285/98 |
| 2,587,938 | 3/1952 | Warren | 285/168 X |
| 2,812,960 | 11/1957 | Walsh | 285/276 |
| 2,817,543 | 12/1957 | Corsett | 285/281 |
| 2,879,083 | 3/1959 | Corsette | 285/168 X |
| 3,303,972 | 2/1967 | Van Loben Sels | 222/529 X |
| 3,405,959 | 10/1968 | Walker | 285/276 |
| 3,473,832 | 10/1969 | Kreidel, Sr. et al. | 285/98 |
| 4,245,759 | 1/1981 | Baker et al. | 222/146.5 |
| 4,313,624 | 2/1982 | Zierden et al. | 285/276 X |
| 4,323,269 | 4/1982 | Pellenc | 285/276 X |
| 4,378,959 | 4/1983 | Susnjara | 901/43 X |

FOREIGN PATENT DOCUMENTS

| | | | |
|---|---|---|---|
| 937178 | 8/1948 | France . | |
| 1178401 | 1/1970 | United Kingdom | 118/323 |

OTHER PUBLICATIONS

ASEA IRB 6/2 Robot, "Robot Gluing".

*Primary Examiner*—Evan K. Lawrence
*Attorney, Agent, or Firm*—Wood Herron & Evans

[57] ABSTRACT

A fluid dispensing system comprises an automatic hot melt fluid adhesive dispensing gun block for dispensing the adhesive onto a surface rotatably connected to a working arm of a programmable working machine. A nozzle is attached to the gun block and communicates through a rotatable spindle on the gun block and a hose with a source of fluid. The gun block is rotatable about an axis extending perpendicularly through the nozzle and to the surface onto which fluid is dispensed. Fluid is dispensed from the nozzle in a direction parallel to the surface. The gun block is rotatable such that the nozzle can maintain a uniform orientation to the dispensed fluid regardless of the relative direction of motion between the gun block and the surface receiving the fluid. Methods of using the fluid dispensing system are disclosed.

12 Claims, 6 Drawing Sheets

PRIOR ART 28A
28B
28C
28D
28E
28F
28G

FLUID DISPENSING SYSTEM AND METHOD FOR DISCHARGING THERMOPLASTIC RESIN ONTO A SURFACE

This is division of application Ser. No. 450,260, filed Dec. 16, 1982, now U.S. Pat. No. 4,592,495.

BACKGROUND OF THE INVENTION

The present invention relates to a connecting mechanism for a thermoplastic resin supply hose in an automatic gun for discharging thermoplastic resin onto a surface.

More particularly, the present invention relates to a method and moving apparatus, or system for uniformly discharging a fluid, such as hot melt adhesive in the form of thermoplastic resin, irrespective of the relative direction of motion between the apparatus and a fluid receiving surface.

Generally speaking, an automatic gun for thermoplastic resin is often used for hot melt, and the explanation pertains to the use of hot melt. Hot melt is simply thermoplastic resin, and its materials include EVA-based, saturated polyester-based, polyamid-based, and polyolefin-based materials, other copolymers or their modified products, and rubber-based materials without vulcanization such as butyl rubber, polyisobutylene rubber, polybutene, SBR, etc. Since all of the above materials have great adhesive power, they are used in many fields such as for joint sealing, for the assembling of laminated paper consisting of paper, plastics, metal, wood ceramics, etc., and for assembly work involving various types of plates, unwoven cloth, chinaware, packing bags and boxes, plastic building materials, machinery tool parts, glass products, etc. The materials are spread as an adhesive or sealing agent by means of a hot melt applicator.

SUMMARY OF THE INVENTION

When dispensing hot melt from a nozzle, it is desirable to maintain a uniform shape in the dispensed bead of hot melt on the receiving surface. When the relative motion between the nozzle and hot melt receiving surface is changed, such uniformity is not possible for many nozzles as hereinafter pointed out.

Accordingly, it is one objective of this invention to provide apparatus and methods of dispensing a uniform bead of fluid from a nozzle onto a surface regardless of the relative direction of motion between the nozzle and the surface.

To these ends, a preferred embodiment of the invention includes a fluid dispensing system for use with a movable working arm of a programmable working machine for dispensing fluid onto a surface. A gun block is mounted to the working arm so as to be movable and rotatable with the working arm. Movement is accommodated in multiple directions with respect to and parallel to the surface. A nozzle, having an outlet means through which fluid is dispensed, is attached to said gun block and is rotatable therewith. The gun block has a fluid passage communicating with said nozzle. A swivel assembly is rotatably mounted on the gun block. A hose is connected between a source of fluid and the swivel assembly such that said gun block can be rotated independently of said hose. The swivel assembly serves to place the hose and said fluid passage in communication. The nozzle outlet means bears a predetermined uniform orientation to the fluid being dispensed on the surface for all movements of said gun block relative to said surface. As the gun block is turned to maintain predetermined orientation of the outlet means to the dispensing fluid, the swivel assembly accommodates rotation of the gun block and nozzle relative to said hose such that said nozzle outlet means can be so oriented.

Generally, the gun block is rotatable about an axis and fluid is dispensed in an direction normal to the axis and parallel to the direction of relative movement between the gun block and the surface. Thus as the direction is changed, and the gun block rotated, the dispensing bead shape is maintained.

Further objects and features of the invention will be apparent from the following description of the specific embodiment of the invention in connection with the accompanying drawings. It should be understood that this description is in no way limiting and that various changes may be brought to the disclosed embodiment without departing from the scope of the invention.

DETAILED DESCRIPTION OF A SPECIFIC EMBODIMENT

Figure 1A:
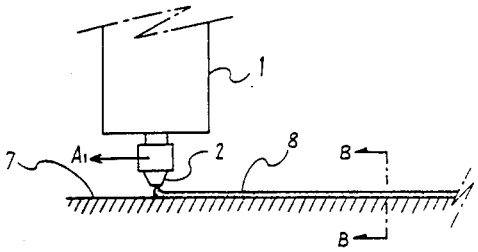
PRIOR ART Fig 1A
FIG. 1A is a side view which explains the former discharge situation for hot melt.

The emitting and spreading conditions are illustrated for the uses described above in FIG. 1A. Hot melt is emitted and spread on the surface of the material to be assembled by a dispenser 1 by locating the hot melt-emitting nozzle 2 close and almost perpendicular to said surface and by moving it in a certain direction $A_1$ (or by moving the material to be assembled past the nozzle). In this case, the discharge hole of the nozzle is either in the shape of a circle 4 (in FIG. 1C) or a slit 9 (FIG. 1D).

Figures 1B, 1C, 1D, 1E:
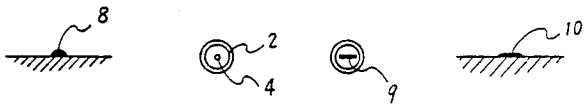
FIG. 1B shows the cross section B—B of FIG. 1A.
FIG. 1C is a front view of a circular nozzle (the base of the nozzle) for hot melt.
FIG. 1D is a front view (the bottom of a nozzle) of a slit-type nozzle for hot melt.
FIG. 1E is a cross section of a band obtained by the use of a slit-type nozzle shown in FIG. 1D to spread hot melt.

The material is discharged as strips 8, whose section is semicircular as shown in FIG. 1B when the discharge hole is circular or flat 10 as shown in FIG. 1E when the hole is slit-shaped. When the discharge hole is circular, the nozzle can be moved in any direction. When the hole is a slit, however, the nozzle is often moved in a line, since it is necessary to provide for perpendicular motion; that is; the slit is undirectional. In other words, it is impossible to emit thermoplastic resin in all directions through a slit-type nozzle.

Furthermore, a strong demand has developed not only for emitting adhesives, but also for forming bands with a specific sectional shape (hereafter referred to as profile), i.e., with a two- or three-dimensional shape for the emitted outline of the band.

A nozzle is preferred in which the nozzle hole faces one direction in the side wall of the nozzle to discharge and spread bands with a complex profile. The outline of such a nozzle is explained in the following. As shown in FIG. 2B, the nozzle 12 is made in the shape of a tube with a top end having threads 13 therein and a bottom end 13A. A nozzle hole 14 is located in one of the side walls of this nozzle.

Figure 2A:
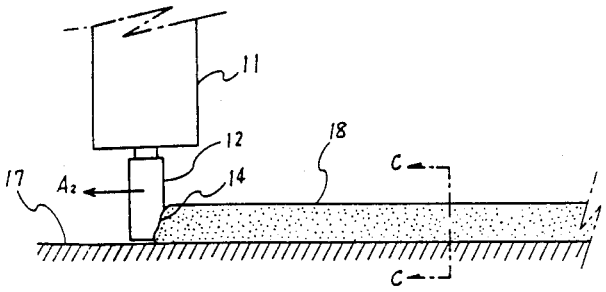
FIG. 2A is a side view which explains the action of the tube-type nozzle installed on the automatic gun of the present invention.
Figure 2B:
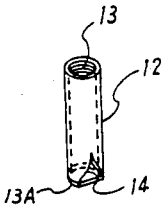
FIG. 2B shows an external view of said tube-type nozzle.
Figure 2C:
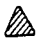
FIG. 2C shows section C—C of FIG. 2A.

The conditions under which hot melt is discharged and spread from a dispenser 11 through said nozzle are illustrated in FIG. 2A. A hot melt band 18 is discharged and molded through said nozzle by moving said nozzle in a certain direction $A_2$; that is the required profile is discharged, applied, spread, and adhered to the surface of the material to be assembled 17. In this case, the nozzle must move in a direction $A_2$ opposite to the direction in which the above-mentioned nozzle hole 14 points. Therefore, when the outline of a hot melt band to be emitted must be curved, the direction of nozzle movement must change along this curve part by part. When hot melt bands for sealing in particular are to be emitted, a nozzle, that is, a gun, which is housed in a body with said nozzle, must be ultimately rotated by 360°, since most bands are of the profile type and are endless.

Figure 3:
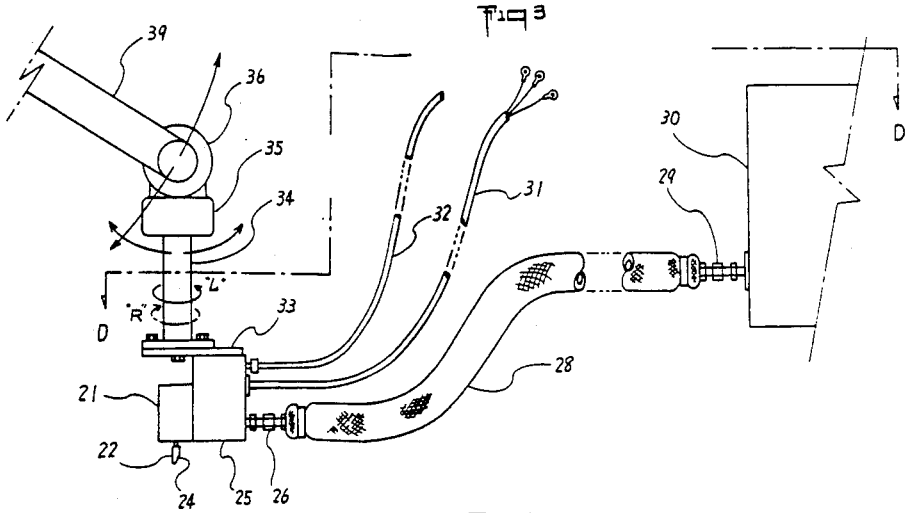
PRIOR ART Fig 3
FIG. 3 is a side view of a former automatic gun installed at the tip arm of an industrial robot.
Figures 5, 6, 7:
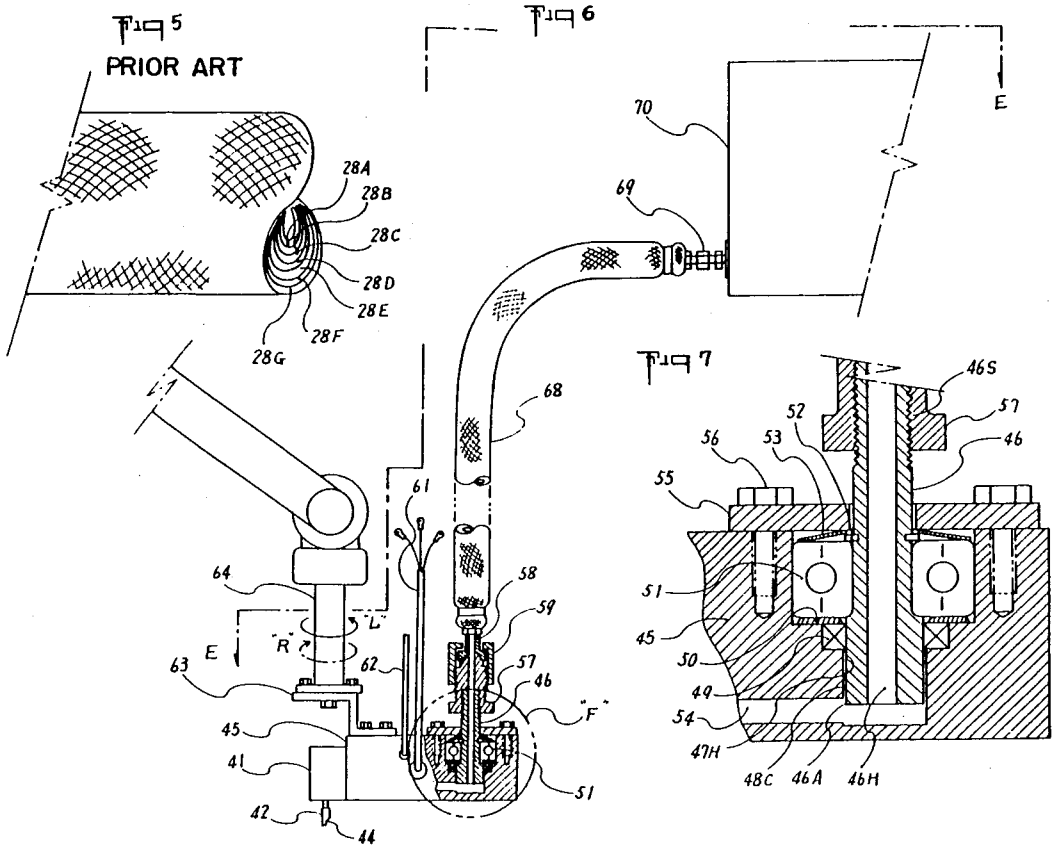
Fig 5 PRIOR ART
FIG. 5 illustrates the design of the hot melt supply hose.
FIG. 6 is a side view sectional drawing of the connection between the automatic gun of the present invention and the hot melt supply hose.
FIG. 7 is a detailed drawing of the "F" portion of FIG. 6.

However, this is impossible with the former hot melt gun. FIG. 3 illustrates the case in which the former hot melt gun is installed on an industrial robot 35. Industrial robot 35 includes arms 34 and 39 joined at joint 36. In FIG. 3, the symbol 25 represents the gun body or block; 21 is the hot melt emitting valve installed on said gun body; and 22 is the nozzle installed at the lower portion of said valve, which is of the tube type and has a nozzle hole 24 in one of its side walls (on the right side of the figure). The gun body is connected to arm 34 of the industrial robot by a connector 33. A hot melt supply hose 28 is attached to the above gun body by a fitting 26 and is connected to a hot melt applicator 30 by another fitting 29. This hose must not only be heat-resistant and pressure-resistant, but must also be insulated, automatically temperature-controlled, and slightly flexible. That is to say, the hose is constructed of seven layers as shown in FIG. 5. These layers are, from the inner layer to the outer layer, a Teflon tube 28A, a stainless tube 28B, insulation tape 28C, a band heater 28D, foamed silicone 28E, Nylon netting 28F, and shrink rubber 28G. Therefore, the hose is relatively thick and is not very flexible. In addition, a flexible conduit 31 and an air hose 32 are connected to the above gun body.

Figure 4:
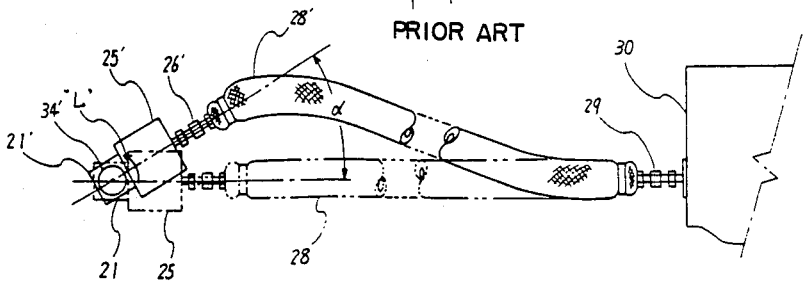
Fig 4 PRIOR ART
FIG. 4 is a ground plan to explain the action of the automatic gun shown in FIG. 3.

When the above gun body rotates around the arm 34 of an industrial robot, the wiring conduit and the air hose can follow easily, since they are very flexible as shown in FIG. 4; but the hot melt supply hose has a very small rotation angle because of its thickness. As described above, therefore, it is impossible for the hose to rotate 360°.

It is the purpose of the present invention to provide a swivel connection for the above automatic gun body and the thermoplastic resin (hot melt) supply hose by providing a hollow spindle, which is supported and sealed with bearings and an O-shaped seal in said automatic gun body, and which projects slightly from said automatic gun body, and by connecting said hollow spindle and the above thermoplastic resin (hot melt) supply hose by means of metal connector fittings in the connecting portion between the thermoplastic resin (hot melt) supply hose and the automatic gun body.

The present invention is summarized by the concept of installing a hollow spindle, which is supported and sealed with bearings and an O-shaped seal in an automatic gun body, and of connecting the projecting portion of said hollow spindle by means of metal fittings located at the end of a thermoplastic (hereafter referred to as hot melt) supply hose. Therefore, it is possible for hot melt supplied from the above hot melt supply hose to pass through the above hollow spindle and always reach the gun body even when the rollow spindle is rotating. That is to say, the automatic gun body can be freely rotated by freeing the nozzle, even when hot melt is being supplied. In other words, it is possible to change the discharge direction freely from the nozzle and easily to provide endless profile-type bands with any desired outline.

The structure of the present invention is explained in the following on the basis of FIGS. 6 and 7. An automatic gun body 45 provides air for operating an air valve, electricity for operating said air valve and an electromagnetic valve, etc., and supplies hot melt to a discharge valve 41, which is connected to the body. A hollow spindle 46 for supplying hot melt is first installed in the above automatic gun body 45, and said hollow spindle is supported in bearings 51. A bearing plate 50, a bearing washer 53, and a snap ring 52 are attached as accessory metal fittings for these bearings. A bearing cover 55 is bolted by bolts 56 to gun body 45. An O-shaped seal 49 is attached to the lower portion of the bearings of the hollow spindle supported as described above. The necessary properties of the O-shaped seal include heat resistance (above 300° C.) and pressure resistance (about 100 kg/cm$^2$). The gap 48C between the outer diameter of the hollow spindle 46 and the hole to hold the hollow spindle 47H is tightly sealed. The hollow portion 46H of the bottom 46A of the hollow spindle is open and connected to the path 54 leading to the discharge valve 41. The upper portion of the above hollow spindle projects slightly beyond the automatic gun body, and a male screw thread 46S is cut in it. This male screw thread is connected to a metal connector fitting 57 located at the end of the hot melt supply hose 68. Although not shown in the figures, a rotary joint for air and a rotary contact for electricity can be installed whenever deemed necessary, since the above-mentioned flexible conduit 61 and air hose 62 have relatively great flexibility. A flange 63 is bolted to the tip arm 64 of the robot and the gun body 45 so that the rotation of the tip arm 64 rotates the gun body 45.

Figure 8:
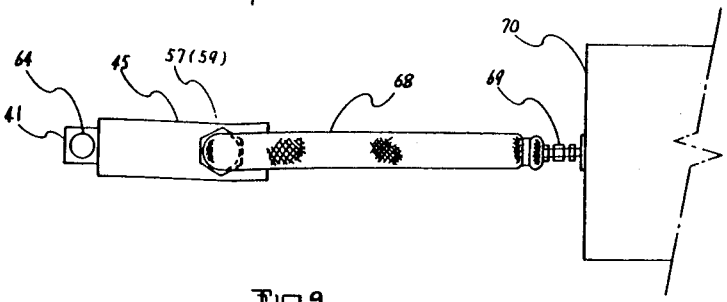
FIG. 8 is a ground plan of FIG. 7.
Figure 9:
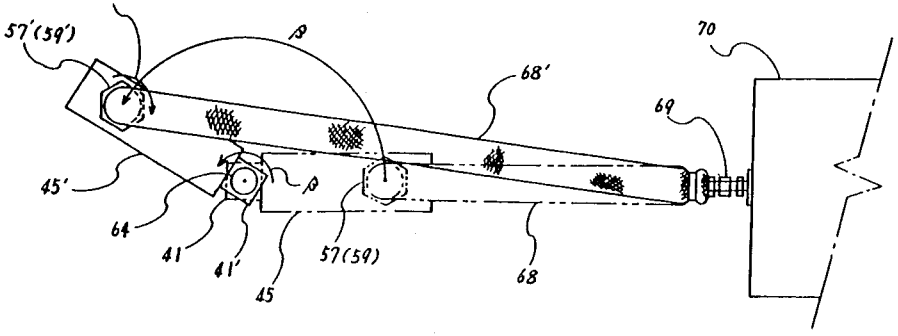
FIG. 9 illustrates a drawing to explain the action in FIG. 6 (and FIG. 8)

The action of the automatic gun of the present invention is explained in the following on the basis of FIGS. 6 and 8. FIG. 8 is a ground plan of FIG. 6. Hot melt (including bulk melt) is melted by a hot melt applicator 70 and moved through a hot melt supply hose 68 by means of a pressurized transfer pump. Hose 68 is connected to applicator 70 by fitting 69. The holt melt flows through the metal connector fittings 57, 58, 59, located at the end of the above supply hose, through the hollow spindle 46 and into the path 54 leading to the discharge valve 41 of the automatic gun 45. When the tip arm 64 of an industrial robot rotates around its axis (concentric to the axis of the nozzle 42) by a certain angle B, the automatic gun body also rotates by the same angle as shown in FIG. 9. In such a case, the above hollow spindle 46 also follows and rotates by the angle B. The hose will not restrict the motion, because there is enough looseness so that the hot melt supply hose 68 can follow easily. That is to say, it can easily rotate 360° around the nozzle.

Figure 10:
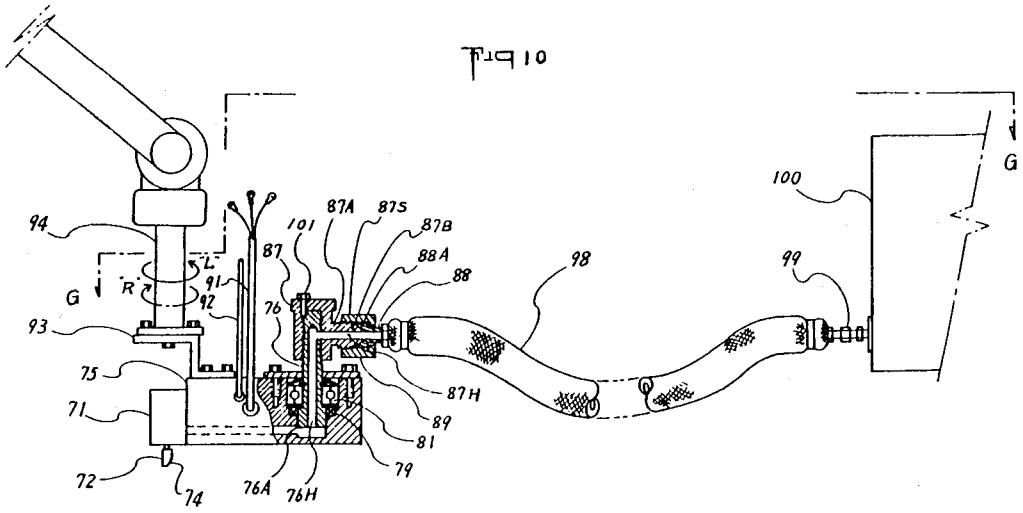
FIG. 10 is a side view sectional drawing of the use of an elbow type metal fitting for the hot melt supply hose.
Figure 11:
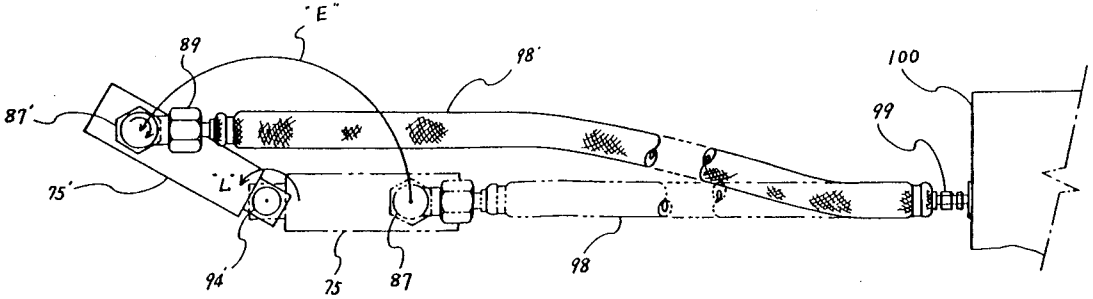
FIG. 11 is a ground plan of the action of FIG. 10.

The coupling between the hot melt supply hose and the automatic gun body described above is based on the connection with straight tube-type metal fittings, but it is naturally possible to connect them with elbow type metal fittings. Its sectional diagram is shown in FIG. 10. This type of fitting functions exactly like the straight tube-type metal fittings as shown in FIG. 11, and therefore a detailed explanation is omitted. However, the following elements and reference numerals correspond: hot melt supply hose 98, fitting 99, applicator 100, metal connector fittings 88A, 87B, 87S, 87A, 87, 88, 89, bearings 81, O-shaped seal 79, hollow 76H, hollow 87H, bolt 101, spindle 76, spindle bottom 76A, nozzle 72, nozzle hole 74, discharge valve 71, gun body 75, flexible conduit 91, air hose 92, robot arm 94, and flange 93.

In the above description, thermoplastic resin has been explained in the form of hot melt, but it is obvious that other general thermoplastic resins can also be used. Adhesive power is not always required for bands of sealing materials, spacers, etc. The use and operational conditions for general thermoplastic resins are exactly the same as for the hot melt described above, and their explanation is omitted.

As described above, a swivel connector type automatic gun of the present invention makes it possible to rotate the automatic gun freely around the nozzle while supplying molten thermoplastic resin to said automatic gun body and to discharge a thermoplastic resin band with a given profile and to spread said band in any outline onto the surface of the material to be treated.

While we have disclosed specific embodiments of our invention, persons skilled in the art to which this invention pertains will readily appreciate changes and modifications which may be made in the invention. Therefore, we do not intend to be limited except by the scope of the following appended claims.

What is claimed is:

1. A fluid dispensing system for use with a movable working arm of a programmable working machine for dispensing fluid onto a surface and comprising:

a gun block mounted to the working arm so as to be movable and rotatable with the working arm, in multiple directions with respect to and parallel to said surface;

a nozzle, having an outlet means through which fluid is dispensed, said nozzle being attached to said gun block and rotatable therewith;

said gun block having a fluid passage communicating with said nozzle;

a source of fluid;

a hose having one end connected to said source;

a swivel assembly rotatably connected at one end thereof to said gun block and connected at the other end thereof to said hose such that said gun block can be rotated independently of said hose;

said swivel assembly placing said hose and said fluid passage in communication;

and said nozzle outlet means bearing a predetermined uniform orientation to the fluid being dispensed on the surface for all movements of said gun block relative to said surface;

said swivel assembly accommodating rotation of said gun block and nozzle relative to said hose such that said nozzle outlet means can be so oriented.

2. The fluid dispensing system of claim 1 wherein said swivel assembly includes:

a spindle having a hollow therethrough, said spindle having opposite ends;

a bearing assembly in said gun block and in which said spindle is journalled; and one end of said spindle being connected to said hose and the other end of said spindle operatively communicating with said passage so that fluid passes from said hose through said hollow to said nozzle.

3. The fluid dispensing system of claim 1 including a spindle mounted on said gun block and wherein said gun block rotates relative to said spindle and hose so that rotational movement of said block is not transferred to said hose.

4. A fluid dispensing system as in claim 1 wherein said gun block is rotatable by said working arm through substantially 360°.

5. A fluid dispensing system as in claim 1, wherein said fluid is dispensed in bead form onto said surface, and wherein said nozzle is oriented uniformly to said bead on said surface throughout all positions of said gun block with respect to said surface during respective movement therebetween.

6. A fluid dispensing system as in claim 1, wherein said gun block is rotatable about an axis, said nozzle being disposed to dispense fluid in a direction normal to said axis, and said direction being parallel to the direction of relative movement between said gun block and said surface.

7. A fluid dispensing system as in claim 6, wherein said nozzle is disposed on said axis of rotation of said gun block.

8. A fluid dispensing system as in claim 7, wherein said swivel assembly is spaced from said axis of rotation of said gun block.

9. A fluid dispensing system as in claim 8, wherein said swivel assembly is rotatable about a second axis parallel to said axis of rotation of said gun block.

10. Apparatus for dispensing a uniformly profiled bead of thermoplastic resin onto a surface and in multiple directions thereon, said apparatus for use with a movable working arm of a programmable working machine and comprising:

a gun body mounted to the working arm and movable therewith, in said multiple directions, relative to and parallel to the surface;

nozzle means for dispensing resin from a nozzle outlet in an elongated, profiled shape onto, and in a direction parallel to, the surface, said nozzle means operatively connected to said gun body;

a resin passageway extending within said body in operative communication with said nozzle;

a source of resin;

a hose means operatively connected between said resin source and said gun body for transferring resin from said source and to said resin passageway and said nozzle means;

swivel means rotatably mounted to said gun body for connecting said hose to said resin passageway in said gun body, for accommodating rotation of said gun body and said nozzle means relative to said hose when said gun body is rotated by said movable arm, and for preventing twisting of said hose when said gun body is so rotated;

said gun body and nozzle means being rotatable by said working arm with said nozzle outlet bearing a predetermined uniform orientation to the resin being dispensed on the surface for all movement of said gun body relative to said surface and to said hose, said nozzle outlet being so oriented, with respect to said surface, to thereby dispense a consistently shaped, profiled bead onto said surface throughout the movement of said gun body relative to said surface;

said swivel means accommodating rotation of said gun block and nozzle means relative to said hose so that said nozzle outlet can be so oriented.

11. A fluid dispensing system for use with a movable working arm of a programmable working machine for uniformly dispensing a fluid bead onto a surface for all relative movement between said system and said surface, and comprising:

a gun block mounted to the working arm so as to be movable with, and rotatable by, the working arm;

a nozzle through which a fluid bead is dispensed being attached to said gun block;

said gun block having a fluid passage operatively communicating with said nozzle;

a source of fluid;

a hose for operably conveying fluid from said source to said gun block fluid passage and said nozzle;

means connecting said hose to said gun block with said gun being rotatable about said connecting means;

said gun block being rotatable by said working arm about a first axis and being rotatable about said axis with respect to said hose;

said nozzle being disposed to dispense a fluid bead in a direction perpendicular to said axis; and said gun block and nozzle being mounted for rotation about said first axis without interference from the disposition of said hose and for relative movement in multiple directions with respect to and parallel to said surface, the direction of such movement being parallel to the direction of the dispensing fluid bead from said nozzle such that said nozzle, independently of the disposition of said hose, is oriented uniformly to said dispensed bead throughout all said relative movement of said gun block and nozzle with respect to said surface.

12. A method for dispensing a uniform fluid bead onto a surface from a dispenser having a nozzle, and moving in predetermined directions relative to said surface, the method comprising:

supplying fluid to a dispenser nozzle;

moving said nozzle with respect to and in a plane parallel to a surface;

dispensing a fluid bead from said nozzle onto said surface in a direction parallel to that of said relative movement; and rotating said nozzle with changes in the direction of said relative movement and thereby maintaining the same disposition of said nozzle, with respect to the dispensing bead, for all relative motion of said surface with respect to said nozzle, to maintain a uniform fluid bead on said surface.

* * * * *